US005890368A

United States Patent [19]

Lakdawala

[11] Patent Number: 5,890,368

[45] Date of Patent: Apr. 6, 1999

[54] DEHUMIDIFIER

[76] Inventor: Ness Lakdawala, 119 de Touraine, St. Lambert, Québec, Canada, H9S 4X6

[21] Appl. No.: 855,441

[22] Filed: May 13, 1997

[30] Foreign Application Priority Data

Nov. 14, 1996 [CA] Canada ..... 2190316

[51] Int. Cl.[6] ..... F25D 21/06

[52] U.S. Cl. ..... 62/81; 62/93; 62/173; 62/278; 62/428; 62/151

[58] Field of Search ..... 62/151, 180, 277, 62/278, 81, 93, 186, 426, 419, 272, 428, 173

[56] References Cited

U.S. PATENT DOCUMENTS 2,481,348 9/1949 Ringquist et al. ..... 62/278 X
3,529,436 9/1970 Brennan ..... 62/278 X
3,572,052 3/1971 Toth ..... 62/278
4,928,498 5/1990 Gossler ..... 62/278 X

*Primary Examiner*—Harry B. Tanner

[57] ABSTRACT

A new method for defrosting a dehumidifier. The new method minimizes the formation of liquid "slugs" which can occur during normal defrosting and which can damage the compressor, and also makes the operation of the dehumidifier more efficient. In the new method, defrosting takes place with the fan running to draw warm, room air over the condenser to warm the refrigerant passing through it in reverse, to thus minimize the formation of liquid "slugs". The warm air however is prevented by baffles from passing over the evaporator where it would undesirearably pick up moisture from the melting ice on the evaporator. An apparatus for carrying out the above method is also provided.

18 Claims, 2 Drawing Sheets

DEHUMIDIFIER

BACKGROUND OF THE INVENTION

1. Field of the Invention

This invention is directed toward a new dehumidifier and a method for operating the dehumidifier.

The invention is more particularly directed toward a dehumidifier with novel means for use in defrosting the dehumidifier and a novel method for defrosting the dehumidifier.

2. Description of the Related Art Including Information Disclosed Under CFR §§ 1.97–1.99

Known dehumidifiers have a conditioning area in an air duct. An air mover, such as a fan, in the air duct draws air from a room through the conditioning area to dehumidify it. The conditioning area has an evaporator for cooling a portion of the air passing through the duct to cause moisture to condense from the air onto the evaporator to control its humidity. The moisture is collected from the evaporator in a drain pan located under the evaporator. The conditioning area also has a condenser for heating the remainder of the air passing through the duct. This heated air portion is mixed with the dehumidified air portion so that the air returned to the room is at a slightly higher temperature than the temperature at which it left the room but less humid.

A compressor circulates refrigerant through the conditioning area during dehumidification. The refrigerant leaves the compressor as a hot gas and at high pressure and normally passes through the condenser heating the portion of air passing over the condenser. The refrigerant is condensed to a liquid state in passing through the condenser. The liquid refrigerant then passes through a restrictor where it expands and lowers in temperature. From the restrictor, the refrigerant enters the evaporator as a mixture of gas and liquid at low pressure and temperature where it cools the portion of air passing over the evaporator. The refrigerant is returned to the compressor to repeat the cycle.

As the dehumidifier operates, ice can build up on the evaporator. The ice build up lowers the efficiency of the evaporator in cooling the air and restricts air flow. The dehumidifier must therefore be periodically defrosted so that it continues to operate efficiently.

Dehumidifiers are normally defrosted by reversing the flow of refrigerant from the compressor and shutting down the fan in the air duct. The hot refrigerant gas now flows first through the evaporator, melting the ice that has accumulated on it. The cooled refrigerant from the evaporator returns to the compressor through the condenser. Shutting down the air mover prevents the air from picking up moisture from the melting ice on the evaporator and being returned to the room. However, without airflow over the evaporator, defrosting takes quite a while. In addition, part of the cooled refrigerant can liquefy during defrosting and be returned to the compressor as a "slug" of liquid causing damage to the compressor. To minimize the formation of these liquid "slugs", and thus minimize damage to the compressor, defrosting is performed more frequently. This of course lengthens the time that the dehumidifier is not dehumidifying, reducing its efficiency and operating time span.

SUMMARY OF THE INVENTION

It is the purpose of the present invention to provide a novel method for defrosting a dehumidifier that is quick, efficient and safe. It is another purpose of the present invention to provide a dehumidifier with novel means for defrosting the dehumidifier quickly, efficiently and safely without damaging the compressor.

In accordance with the present invention, the dehumidifier is defrosted with the air mover operating. Operation of the air mover during defrosting causes the warm room air to pass over the condenser thus heating the returning cooled refrigerant in the condenser and vaporizing it to eliminate the formation of liquid "slugs" which could damage the compressor. Since the formation of liquid "slugs" is eliminated, the defrosting operation is much safer. In addition, moving warm room air over the condenser to heat the refrigerant makes defrosting quicker and makes the system more energy efficient thus increasing the efficiency of the dehumidifier.

In a normal dehumidifier, running the air mover during defrosting would draw warm room air over the evaporator and drain pan as well as the condenser thus undesireably returning moisture from the melting ice to the air to increase the humidity in the room. However in accordance with the present invention, the air is prevented from passing over the evaporator and drain pan while the air mover runs during defrosting. Blocking means are provided in the conditioning area for preventing the air from flowing over the evaporator and drain pan during defrosting while the air mover runs. Thus the formation of liquid "slugs" is eliminated by having the air mover run during defrosting while at the same time avoiding return of moisture to the air.

In a preferred embodiment of the invention, the blocking means in the dehumidifier comprises a set of baffles located adjacent the evaporator and drain pan. The baffles are open during normal operation of the dehumidifier and are closed during defrosting to prevent the air from being drawn over the evaporator and drain pan by continued operation of the air mover during defrosting.

Since part of the air duct in the region of the conditioning area is closed off by the baffles during defrosting, more air, at a higher velocity, flows through the unblocked area of the duct. This higher, faster, adjacent air stream could still draw off some of the moisture on the evaporator and the drain pan even though direct air flow over the evaporator and drain pan is blocked off. To minimize the moisture pick-up by the adjacent air flow, air flow control means are provided for drawing less air through the conditioning area of the duct when the baffles are closed during defrosting. These air flow control means can comprise speed control means for reducing the speed of the air mover so as to draw less air through the duct and thus through the conditioning means during defrosting. Alternatively, the air flow control means can comprise one or more by-pass channels for directing some of the air that normally flows through the duct around the conditioning area during defrosting. Dampers in the bypass channels would close the by-pass channels during normal operation of the dehumidifier but would open the by-pass channels during defrosting to have less air flow through the conditioning area to minimize moisture pick up.

The invention is particularly directed toward a method for defrosting a dehumidifier of the type having a conditioning area in an air duct and an air mover in the air duct to draw air through the conditioning area. The conditioning area has a condenser, an evaporator, and a drain pan under the evaporator. Refrigerant normally flows through the condenser and then through the evaporator to dehumidify the air. The method comprises the steps of reversing the flow of refrigerant through the conditioning area to have hot refrigerant gas flow first through the evaporator and then through the condenser and operating the air mover during defrosting to draw air over the condenser to heat the refrigerant therein while simultaneously preventing air from being drawn over the evaporator and drain pan during defrosting.

The invention is also directed toward a dehumidifier of the type having a conditioning area in an air duct and an air mover in the air duct to draw air through the conditioning area. The conditioning area comprises a condenser, an evaporator, and a drain pan beneath the evaporator. The dehumidifier has blocking means for preventing the flow of air over the evaporator and the drain pan as the air mover runs during defrosting of the dehumidifier. The dehumidifier also has air flow control means for limiting the amount of air that flows through the conditioning area during defrosting to minimize the air returning water to the room being dehumidified during defrosting.

DESCRIPTION OF THE PREFERRED EMBODIMENTS

Figure 1:
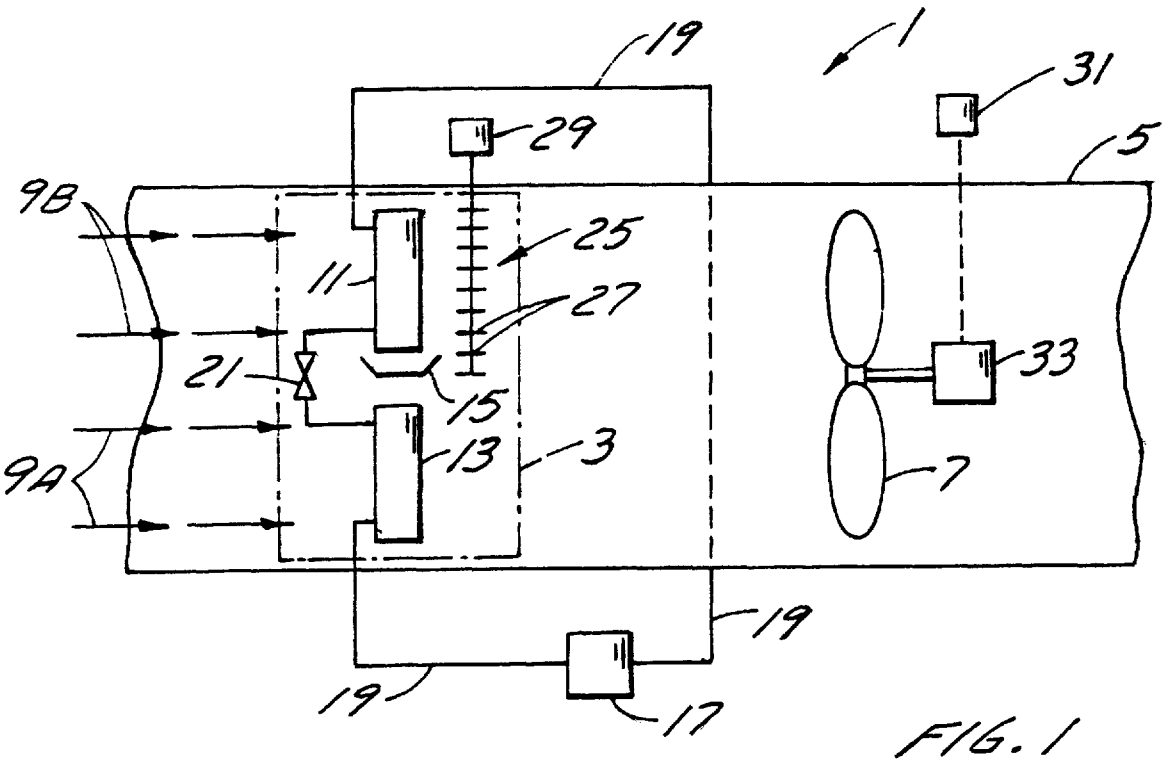
FIG. 1 is a schematic side view of the dehumidifier during dehumidifying.

The dehumidifier 1 of the present invention, as shown in FIG. 1, is of the type having a conditioning area 3 (shown in dotted lines) in an air duct 5. Air is circulated from a room or area through the conditioning area 3 in the duct 5 by an air mover 7, such as a fan or centrifugal blower, in the direction shown by the arrows 9. In the conditioning area 3 there is an evaporator 11 located above a condenser 13. There is also a drain pan 15 beneath the evaporator 11 and above the condenser 13. The evaporator 11 is preferably located above the condenser 13 so that the condenser will be less likely to freeze up during operation of the dehumidifier. In some installations, however, the evaporator 11 can be located below the condenser 13.

During dehumidifying of the air, a compressor 17 compresses a refrigerant and passes it, as a hot gas and at high pressure, through a line 19 to the condenser 13. In the condenser 13, the refrigerant gas gives up heat to heat that portion of the air, shown by the arrows 9A, passing over the condenser 13 through the duct 5. The portion of the air is heated so that all the air is returned to the room or area being conditioned at a temperature slightly higher than the normal temperature required in the area. The refrigerant, now mostly liquid at moderate temperature and high pressure, passes from the condenser 13 through a restrictor 21 where it expands to a mixture of gas and liquid at low pressure and low temperature. This refrigerant is then passed through the evaporator 11 where it cools the remainder of the air, shown by the arrows 9B, passing over it. As the remainder of the air is cooled, moisture condenses from it onto the evaporator 11 and collects in the drain pan 15. The refrigerant, now warmed by the air to a vapour but still at relatively low temperature and pressure, is returned to the compressor 17 by the line 19 for compressing to repeat the cycle. The cooled air passing from the evaporator 11 is mixed in the duct 5 with the warmer air from the condenser 13 and returned to the room or area being conditioned with less moisture than before. The unit described is typical.

The moisture, as it condenses from the air passing over the evaporator 11, can build up as ice on the evaporator 11 thus impairing its efficiency. When the ice buildup on the evaporator 11 becomes too great for efficient operation, the dehumidifier is defrosted. Defrosting is done by reversing the flow of the refrigerant from the compressor 17 so that the hot refrigerant gas passes through the evaporator 11 first from the compressor 17. As the hot gas passes through the coils of the evaporator 11, it melts the ice that has accumulated on the evaporator. The water from the melting ice is collected in the drain pan 15. During defrosting, the air mover 7 is turned off so that the water from the melting ice is not picked up by the air passing through the duct and returned to the room or area being conditioned. The cooled refrigerant, leaving the evaporator 11 and passing through the condenser 13, becomes a mixture of liquid and gas and a liquid "slug" can be returned to the compressor 17 causing damage. To minimize the formation of a liquid "slug", defrosting is performed more frequently which lowers the efficiency of the humidifier. This defrosting cycle is typical.

Figure 2:
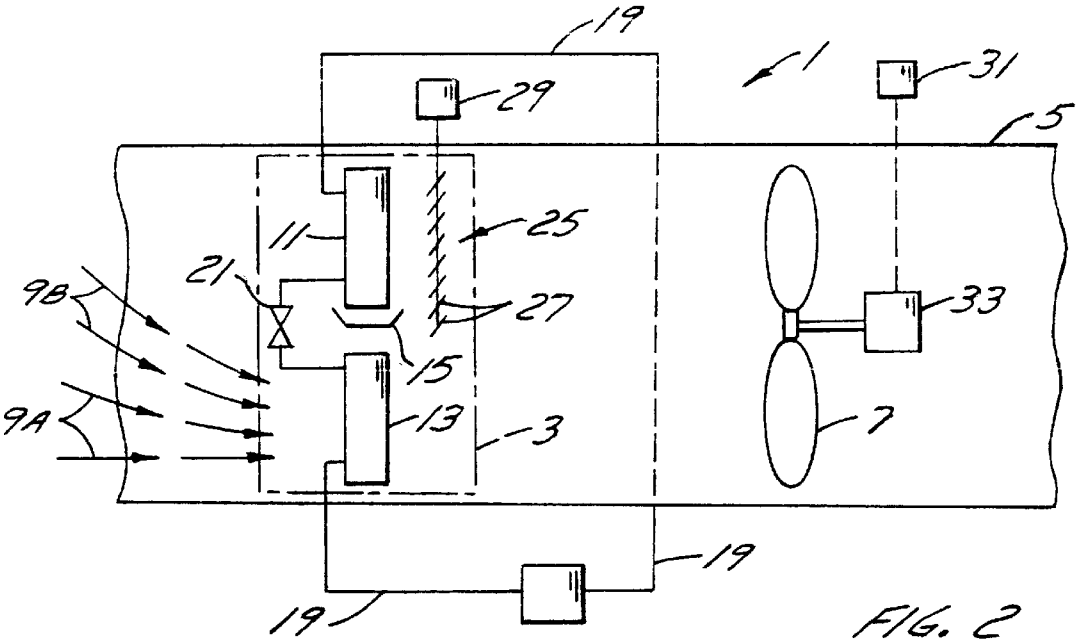
FIG. 2 is a schematic side view of the dehumidifier during defrosting.

The present invention provides means for defrosting the dehumidifier 1 in a much quicker and safer manner. In accordance with the present invention, the air mover 7 is operated during defrosting while blocking means 25 are also operated to block the flow of air, shown by arrows 9B, over the evaporator 11, and its associated drain pan 15 as shown in FIG. 2. Operation of the air mover 7 during defrosting causes it to draw warm room air over the condenser 13. This warm air heats the refrigerant in the condenser 13 to vaporize it and thus eliminates the chance of a liquid "slug" damaging the compressor 17 during defrosting. Heating the refrigerant also makes the defrosting operation quicker and more efficient. The blocking means 25 prevents the warm room air being drawn through the duct 5 by the air mover 7 from passing over the evaporator 11 and the drain pan 15 and this minimizes the warm air picking up and returning moisture to the room.

The blocking means 25 for blocking the flow of air over the evaporator 11 and drain pan 15 can comprise a set of baffles 27 positioned adjacent the evaporator 11 and the drain pan 15. The baffles 27 are open during normal operation of the dehumidifier but are closed during defrosting. A suitable motor 29 can open or close the baffles 27. Suitable controls can be provided to automatically close the baffles 27 by means of the motor 29 during defrosting and to automatically open the baffles 27 after defrosting is completed.

When the baffles 27 are closed during defrosting, as shown in FIG. 2, the air flow through the duct 5, when the air mover 7 is running, is channeled through the condenser 13 as shown by the arrows 9A, 9B. This greater volume of air, at increased speed, passing adjacent the bottom of the drain pan 15 and the evaporator 11, could still pick up moisture and return it to the room. It is therefore preferred to reduce the air flow over the condenser 13 during defrosting to minimize the pick up of moisture from the drain pan and the evaporator. Air flow control means are provided for reducing the flow of air through the conditioning area 3 during defrosting while the baffles 27 are closed. The air flow control means can comprise a speed control 31 for a two speed motor 33 that runs the air mover 7. The speed control means 31 can be automatically operated when switching to the defrosting cycle to lower the speed of the air mover. The speed of the air mover 7 can be automatically reduced from 1800 rpm to 900 rpm, by way of example, using the two speed motor.

Figure 3:
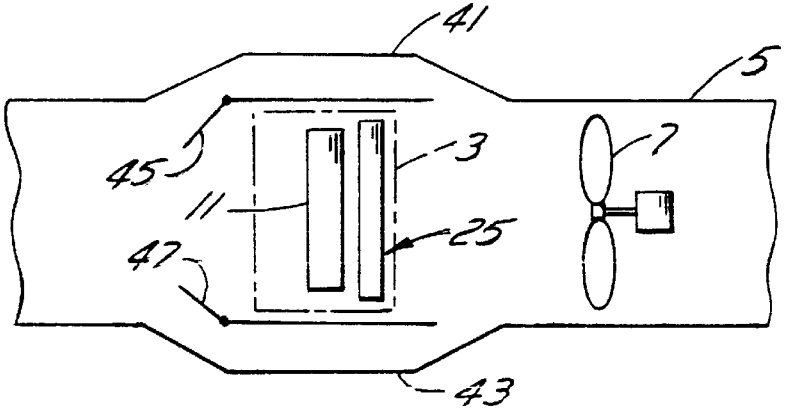
FIG. 3 is a top view of another embodiment of the dehumidifier.

Alternatively, the flow control means can comprise one or more by-pass channels for passing a portion of the air around the conditioning area 3 of the dehumidifier. For example, as shown in FIG. 3, two by-pass channels 41, 43 can be provided on either side of the duct 5 passing around the conditioning area 3 located within the duct 5. The channels 41, 43 are each normally closed by a damper 45, 47 during normal operation of the dehumidifier. During defrosting however, the dampers 45, 47 are opened, as shown in FIG. 3, by motors (not shown) to have some of the room air passing through the duct 5 bypass the conditioning area 3 as the air mover 7 continues operation. The bypass channels 41, 43 are sized to bypass approximately the same amount of air now being blocked by the baffles 27 and more importantly, to by-pass enough air that the remaining air passing through the conditioning area 3 and over the condenser 13 does not pick up moisture from the evaporator 11 and drain pan 15 and carry it back into the room.

A different arrangement of by-pass channels from the one shown in FIG. 3 can be employed. For example, two by-pass channels can be employed, arranged one above the evaporator and one below the condenser to bypass air around the conditioning area.

I claim:

1. A dehumidifier carrying out dehumidifying and defrosting operations and having: a conditioning area in an air duct; an air mover in the air duct to draw air through the conditioning area; the conditioning area having: a condenser, an evaporator, and a drain pan under the evaporator; blocking means in the duct for preventing the flow of air over the evaporator and the drain pan as the air mover runs during defrosting of the dehumidifier to draw air over the condenser; and air flow control means for drawing less air through the conditioning area during defrosting than during dehumidifying.

2. A dehumidifier as claimed in claim 1 wherein said air flow control means comprises at least one by-pass channel for the air duct, and damper means in each channel for selectively opening the channel to by-pass some of the air passing through the duct around the conditioning area during defrosting.

3. A dehumidifier as claimed in claim 1 wherein said air flow control means comprises a two speed motor for the air mover, the motor being controlled for automatically changing the speed of the air mover to the lower speed to draw less air through the conditioning area during defrosting.

4. A dehumidifier carrying out dehumidifying and defrosting operations and having: a conditioning area in an air duct; an air mover in the air duct to draw air through the conditioning area; the conditioning area having: a condenser, an evaporator, and a drain pan under the evaporator; baffle means in the duct adjacent the evaporator and the drain pan, the baffle means movable between a first position to prevent air flow over the evaporator and the drain pan during defrosting when the air mover is operated to draw air over the condenser, and a second position to allow air to flow over the evaporator and drain pan during dehumidifying; and air flow control means for drawing less air through the conditioning area during defrosting than during dehumidifying.

5. A dehumidifier as claimed in claim 4 wherein said air flow control means comprises at least one by-pass channel for the air duct, and damper means in each channel for selectively opening the channel to by-pass some of the air passing through the duct around the conditioning area during defrosting.

6. A dehumidifier as claimed in claim 4 wherein said air flow control means comprises a two speed motor for the air mover, the motor being controlled for automatically changing the speed of the air mover to the lower speed to draw less air through the conditioning area during defrosting.

7. A method of defrosting a dehumidifier having a conditioning area in an air duct and an air mover in the air duct to draw air through the conditioning area, the conditioning area having a condenser, an evaporator, and a drain pan beneath the evaporator; refrigerant normally flowing through the condenser and then the evaporator in the conditioning area to dehumidify the air; the method comprising the steps of: reversing the flow of refrigerant in the conditioning area to have the refrigerant flow first through the evaporator and then through the condenser; operating the air mover during the defrosting to draw air through the conditioning area over the condenser to heat the refrigerant therein while simultaneously preventing air from flowing over the evaporator and drain pan; and reducing the amount of air flowing through the conditioning area during defrosting while the air mover operates to minimize the pick up of moisture from the evaporator and the drain pan by the air.

8. A method as claimed in claim 7 wherein the amount of air flowing through the conditioning area during defrosting is reduced by opening up at least one by-pass channel in the air duct to by-pass some of the air flowing through the duct around the conditioning area and thus minimize the pick up of moisture from the evaporator and the drain pan by the air.

9. A method as claimed in claim 7 wherein the amount of air flowing through the conditioning area during defrosting is reduced by reducing the speed of the air mover in the duct so as to draw less air through the conditioning area and thus minimize the pick up of moisture from the evaporator and the drain pan by the air.

10. A dehumidifier carrying out dehumidifying and defrosting operations and having: a conditioning area in an air duct and an air mover in the air duct to draw air through the conditioning area; the conditioning area having: a condenser, an evaporator, and a drain pan under the evaporator; reversible recirculating means for circulating refrigerant in one direction through the condenser and then through the evaporator to dehumidify and heat the air drawn through the conditioning area, and for selectively circulating the refrigerant in the opposite direction through the evaporator and then through the condenser to defrost the dehumidifier; the air mover operating during defrosting; and blocking means in the duct for preventing the flow of air over the evaporator and the air is drawn ring defrosting so that air is drawn only over the condenser during defrosting.

11. A dehumidifier as claimed in claim 10 wherein the blocking means comprise baffle means adjacent the evaporator and the drain pan, the baffle means movable between a first position to prevent air flow over the evaporator and the drain pan during defrosting, and a second position to allow air to flow over the evaporator and drain pan during dehumidifying.

12. A dehumidifier as claimed in claim 11 including air flow control means for drawing less air through the conditioning area during defrosting than during dehumidifying.

13. A dehumidifier as claimed in claim 12 wherein said air flow control means comprises at least one by-pass channel for the air duct, and damper means in each channel for selectively opening the channel to by-pass some of the air passing through the duct around the conditioning area during defrosting.

14. A dehumidifier as claimed in claim 12 wherein said air flow control means comprises a two speed motor for the air mover, the motor being controlled for automatically changing the speed of the air mover to the lower speed to draw less air through the conditioning area during defrosting.

15. A dehumidifier as claimed in claim 10 including air flow control means for drawing less air through the conditioning area during defrosting than during dehumidifying.

16. A dehumidifier as claimed in claim 15 wherein said air flow control means comprises at least one by-pass channel for the air duct, and damper means in each channel for selectively opening the channel to by-pass some of the air passing through the duct around the conditioning area during defrosting.

17. A dehumidifier as claimed in claim 15 wherein said air flow control means comprises a two speed motor for the air mover, the motor being controlled for automatically changing the speed of the air mover to the lower speed to draw less air through the conditioning area during defrosting.

18. A method of defrosting a dehumidifier having a conditioning area in an air duct and an air mover in the air duct to draw air through the conditioning area, the conditioning area having a condenser, an evaporator, and a drain pan beneath the evaporator; refrigerant normally flowing through the condenser and then the evaporator to dehumidify and heat the air; the method comprising the steps of: reversing the flow of refrigerant through the conditioning area to have the refrigerant flow first through the evaporator and then through the condenser; operating the air mover during the defrosting; and preventing air from flowing over the evaporator and drain pan during defrosting; whereby air is drawn only over the condenser during defrosting to heat the refrigerant therein.

* * * * *